United States Patent [19]

Baker et al.

[11] Patent Number: 4,714,118

[45] Date of Patent: Dec. 22, 1987

[54] TECHNIQUE FOR STEERING AND MONITORING THE ORIENTATION OF A POWERED UNDERGROUND BORING DEVICE

[75] Inventors: Glen Baker, Kent; Albert W. Chau, Redmond; John E. Mercer, Kent, all of Wash.

[73] Assignee: FlowMole Corporation, Kent, Wash.

[21] Appl. No.: 866,241

[22] Filed: May 22, 1986

[51] Int. Cl.[4] ..... E21B 7/08; E21B 44/00

[52] U.S. Cl. ..... 175/26; 175/45; 175/61; 175/62; 175/67; 175/162

[58] Field of Search ..... 175/26, 40, 45, 61, 175/62, 67, 73, 162; 405/248

[56] References Cited

U.S. PATENT DOCUMENTS

| | | | |
|---|---|---|---|
| 3,465,834 | 9/1969 | Southworth, Jr. | 175/73 |
| 3,712,391 | 1/1973 | Coyne | 175/26 |
| 3,853,185 | 12/1974 | Dahl et al. | 175/45 |
| 3,870,111 | 3/1975 | Tuomela et al. | 175/11 |
| 3,891,038 | 6/1975 | Delestrade et al. | 175/45 |
| 4,625,815 | 12/1986 | Spies | 175/73 |
| 4,640,353 | 2/1987 | Schuh | 175/61 |

FOREIGN PATENT DOCUMENTS

| | | | |
|---|---|---|---|
| 3012482 | 10/1981 | Fed. Rep. of Germany | 175/67 |
| 2126267 | 3/1984 | United Kingdom | 175/67 |

*Primary Examiner*—Stephen J. Novosad
*Assistant Examiner*—Terry Lee Melius
*Attorney, Agent, or Firm*—Flehr, Hohbach, Test Albritton & Herbert

[57] ABSTRACT

A technique for providing a continuous underground tunnel is disclosed herein. This technique utilizes an elongated boring device including a forward facing, off-axis high pressure fluid jet which is rotated about the elongated axis of the device while the latter is urged forward through the soil, whereby to cause the device to bore a tunnel through the soil as it moves forward. In accordance with one feature of this technique, the boring device is steered by modulating the speed and/or the direction of rotation of its off-axis fluid jet in a way which depends upon the desired direction to be taken by the boring device within the soil. In accordance with another feature of the overall technique, the pitch angle of the boring device, as defined by its elongation axis, is monitored relative to a horizontal ground plane, independent of the roll position of the device. In accordance with still another feature of the technique, the roll angle of the boring device and the position of its off-axis jet are simultaneously monitored whereby to monitor the precise rotational position of the jet relative to its roll position.

27 Claims, 18 Drawing Figures

TECHNIQUE FOR STEERING AND MONITORING THE ORIENTATION OF A POWERED UNDERGROUND BORING DEVICE

The present invention relates generally to a technique for providing an underground tunnel by means of an elongated boring device which is caused to move through the soil and more particularly to uncomplicated and reliable ways to steer the boring device as it moves through the soil while, at the same time, monitoring its pitch and roll angles.

The present invention is particularly relevant to copending U.S. application Ser. No. 866,240, filed 5-22-1986 and entitled TECHNIQUE FOR PROVIDING AN UNDERGROUND TUNNEL UTILIZING A POWERED BORING DEVICE (attorney docket A-43693). In this application which is incorporated herein by reference and which will hereinafter be referred to as the copending "system" application, an overall system for providing a continuous underground tunnel is disclosed. This system utilizes an elongated boring device including a forward facing, off-axis high pressure fluid jet which is rotated about the elongation axis of the device while the latter is urged forward through the soil. The boring device enters the soil at one point and then follows a specific, path, which may be specifically or generally predetermined, before exiting the soil at a second spaced point. At this latter point, a cable or cables, conduit or pipe such as utility cables, telephone lines and/or the like to be installed in the tunnel are coupled to the boring device and the latter is pulled back through the tunnel with the cables following behind.

It is one object of the present invention to provide an uncomplicated and yet reliable means for and method of steering the boring device recited above.

Another object of the present invention is to monitor the pitch angle of the boring device as it moves through the soil, independent of its roll angle, in an uncomplicated and reliable manner.

Still another object of the present invention is to monitor the roll angle of the boring device while, at the same time, monitoring the rotational position of one of its cutting jets so as to continuously monitor the rotational position of that cutting jet relative to a given reference.

As will be described in more detail hereinafter, the technique for providing a continuous underground tunnel disclosed herein utilizes an elongated boring device having a central elongation axis and including an axially extending main body, a forward boring head coaxially positioned with and rotatably mounted to the main body, and a nozzle on the boring head in a forward facing position, off-axis with respect to the device. Means are provided for supplying fluid under pressure to the nozzle, whereby to produce a pressurized fluid jet at the output of the nozzle in a direction forward of and off-axis with respect to the device. This jet is made sufficiently strong to bore through the soil. At the same time, the boring device is urged forward by means of, for example, a continuous conduit described in the copending system application, whereby to cause the device to continuously move forward into the area being bored out by the jet.

As the boring device just described is urged forward and bores through the soil, its boring head and nozzle are rotated about its axis of elongation in either a first way for causing the device to move forward along a straight line path or in a second way for causing the device to move forward along a particular curved path depending upon the way in which the boring head is rotated. Specifically, when it is desirable to cause the boring device to move along a straight line path, its boring head is rotated at a constant speed around its elongation axis and when it is necessary to turn the device, its boring head is rotated about its elongation axis such that the fluid jet spends more time along a particular segment of its rotating path than along the rest of its path of movement. The particular segment of this rotating path along which the jet spends most of its time determines the particular curved path to be taken by the device.

As the boring device is steered through the soil, it should be apparent that it is important to continuously monitor its position and orientation including specifically its pitch and roll angles and the exact position of its cutting jets relative to a fixed reference. As will be described in more detail hereinafter, the pitch angle of the boring device is monitored relative to a horizontal ground plane and independent of its roll position. At the same time, its roll position is monitored relative to the reference roll position and the rotational position of one of its cutting jets is monitored relative to the same reference roll position. In this way, movement of the cutting jets can be monitored so that they can be appropriately modulated in order to steer the boring device.

The specific way in which the boring device is steered and the specific ways in which its pitch and roll angles are monitored along with the movement of its cutting jets will be described in more detail hereinafter in conjunction with the drawings wherein.

Figures 3A, 3B, 3C:
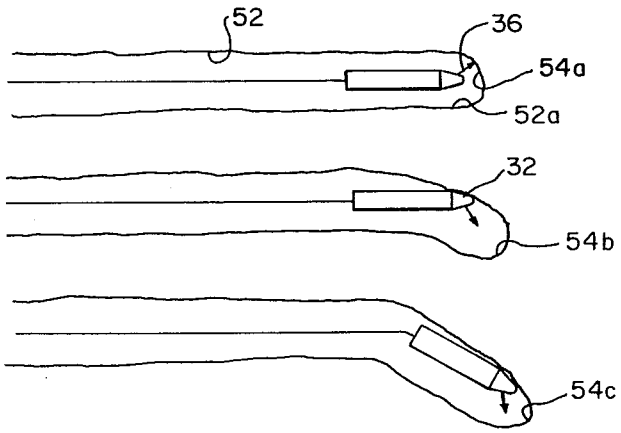
Figure 2:
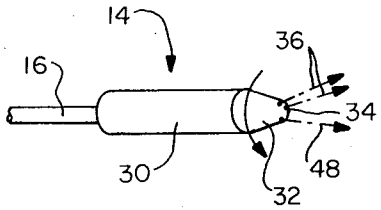
FIG. 2 is a perspective view of a boring device forming part of the overall apparatus of FIG. 1.
Figure 4:
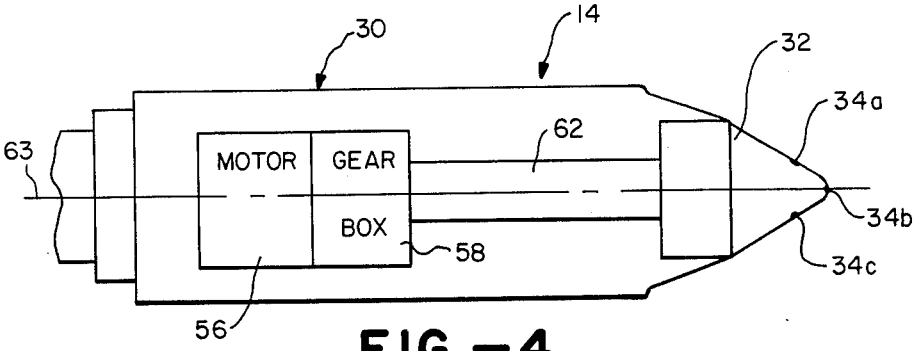
Figure 5A:
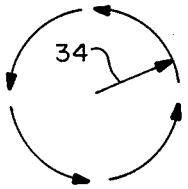
Figure 5B:
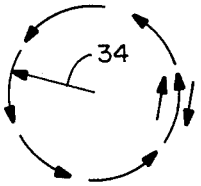
Figure 5C:
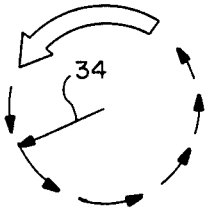
Figure 6:
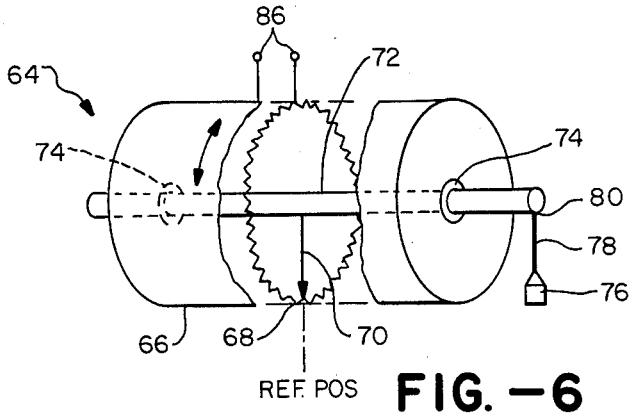
Figure 7A:
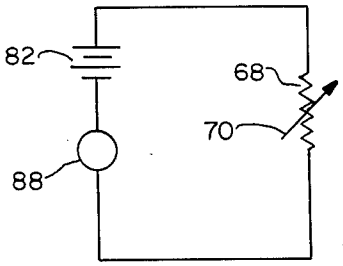
Figure 7B:
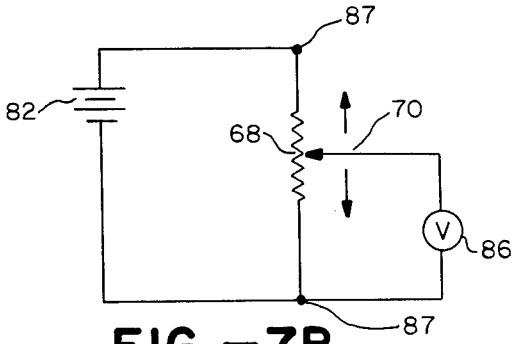
Figure 8:
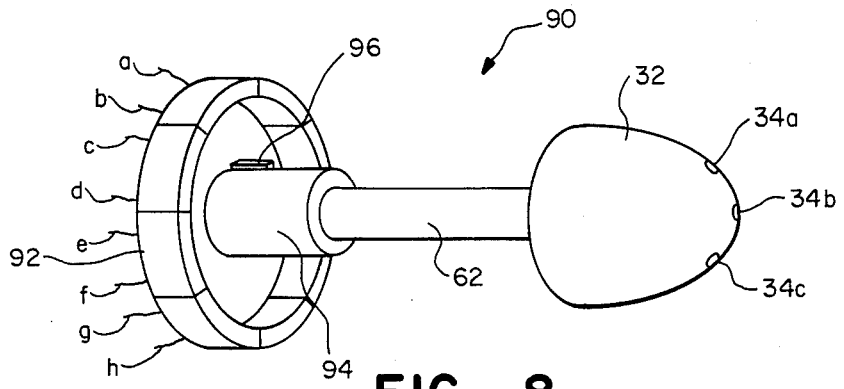
Figure 9:
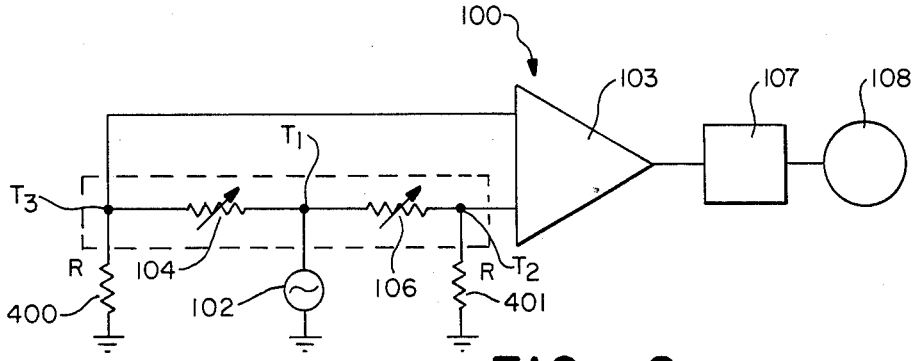
Figure 10:
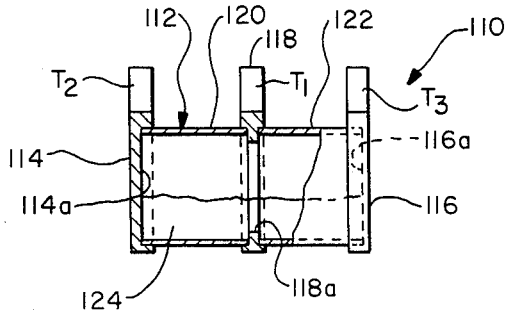
Figure 11:
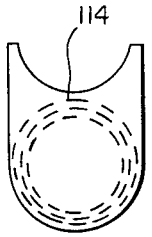
Figure 12:
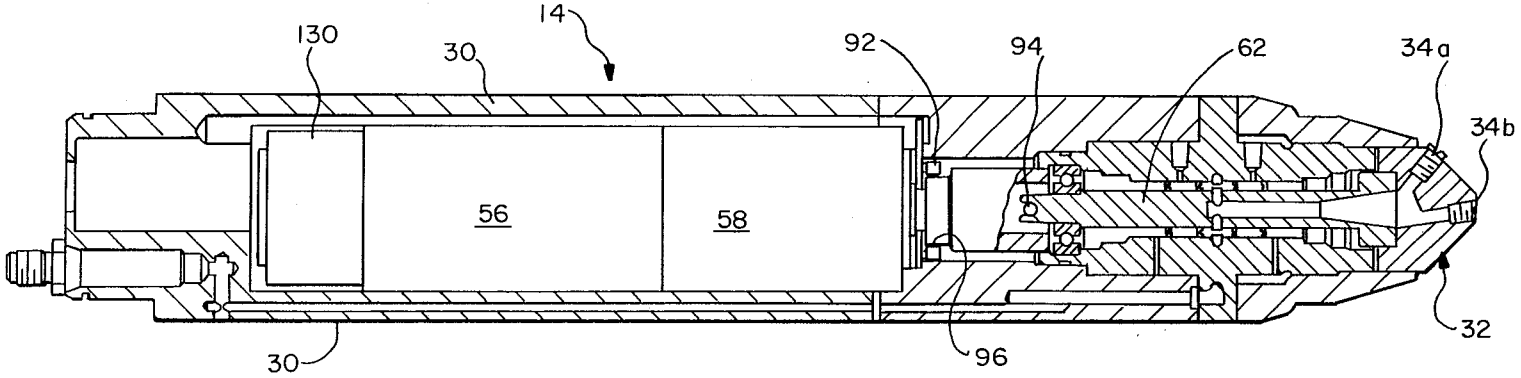
Figure 13:
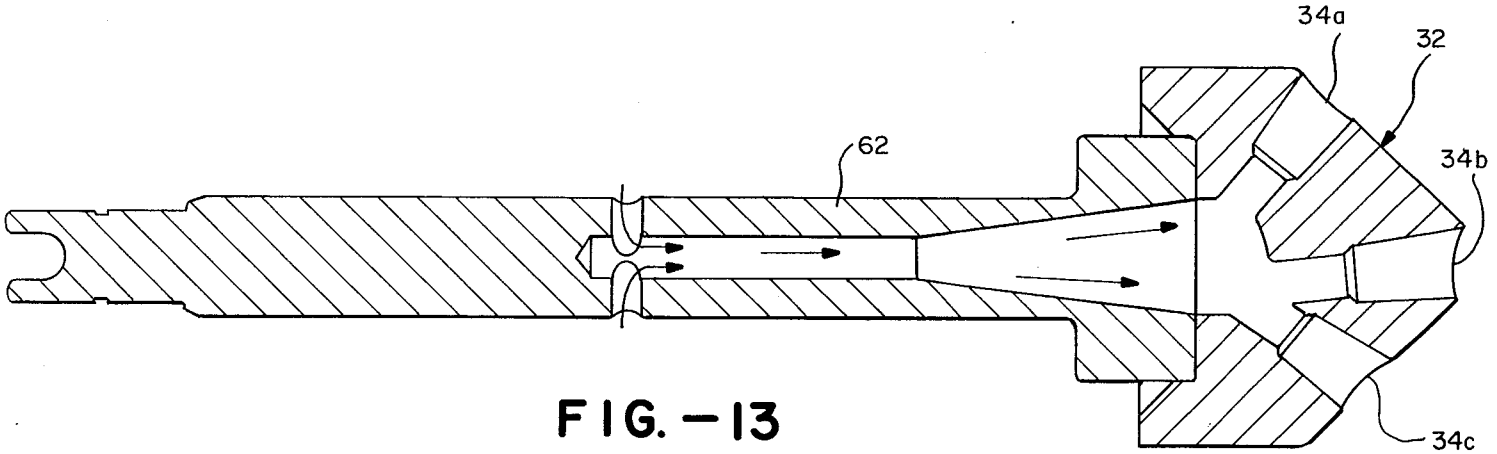

FIGS. 3*a*, 3*b* and 3*c* diagrammatically illustrate how the boring device of FIG. 2 makes turns in the soil as it bores through the latter;

FIG. 4 is an enlarged diagrammatic illustration of certain features of the boring device illusrated in FIG. 2;

FIGS. 5*a*, 5*b* and 5*c* diagrammatically illustrate how the device of FIG. 4 is steered in accordance with the present invention;

FIGS. 6 and 7A, 7B diagrammatically illustrate means designed in accordance with the present invention for monitoring the roll angle of the boring device illustrated in FIG. 4;

FIG. 8 is in part a perspective view, and in part, a diagrammatic illustration of means for monitoring the movement of the boring devices cutting jets;

FIG. 9 is, in part, a diagrammatic illustration and, in part, an electrical schematic representation of an arrangement for monitoring the pitch angle of the boring device of FIG. 4 in accordance with the present invention;

FIG. 10 is a side elevational view of an assembly which is designed in accordance with the present invention and which forms part of the overall arrangement of FIG. 9 for monitoring the pitch angle of the device illustrated in FIG. 4, independent of its roll angle;

FIG. 11 is a side elevational view of the assembly illustrated in FIG. 10;

FIG. 12 is a longitudinal sectional view of an actual working boring device designed in accordance with the present invention; and FIG. 13 is a side sectional view of an actual working boring head which is designed in accordance with the present invention and which forms part of the overall boring device illustrated in FIG. 12.

Figure 1:
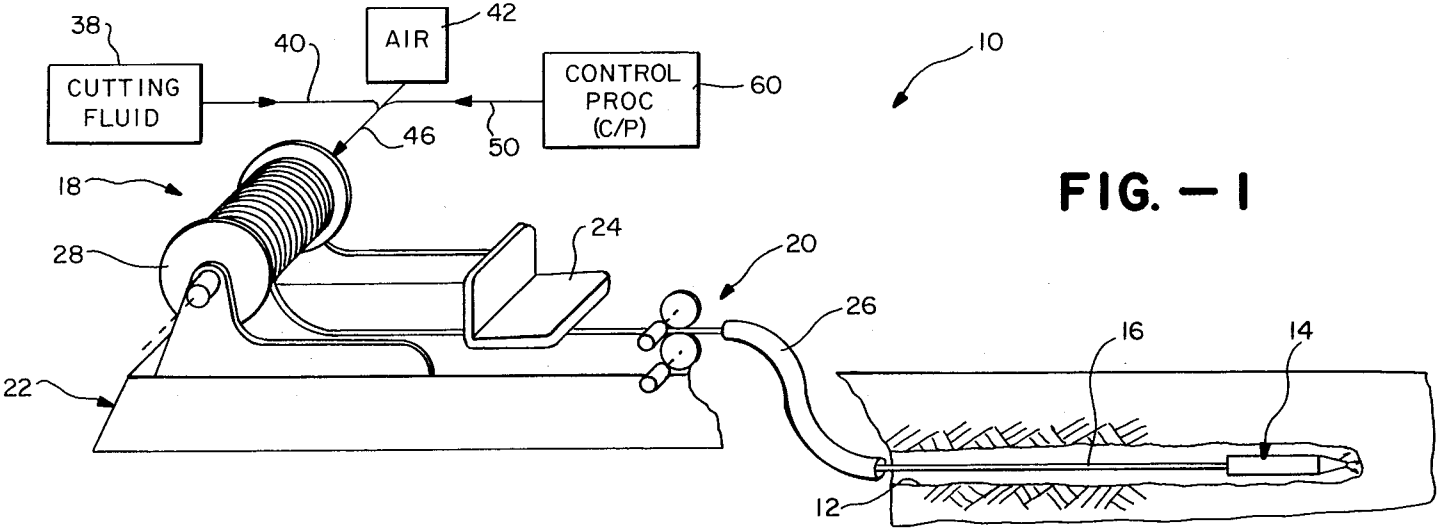
FIG. 1 is a diagrammatic illustration, in perspective view, of an overall apparatus for providing a continuous underground tunnel between first and second spaced-apart points, as described in more detail in the previously recited copending system application.

Turning now to the drawings, wherein like components are designated by like reference numerals throughout the various figures, attention is first directed to FIG. 1. This figure diagrammatically illustrates an apparatus for providing a continuous underground tunnel between a first entry point and a second, spaced apart exit point. The overall apparatus which is described in more detail in the previously recited copending system application is generally indicated at 10 and the tunnel is shown partially finished at 12. The apparatus includes (1) a boring device 14 designed in accordance with a number of different aspects of the present invention, (2) a thrust cable 16, (3) a reel support assembly 18, and (4) a thrust assembly 20. Both the reel assembly 18 and thrust assembly 20 are preferably supported on a trailer generally indicated at 22 which also supports a seat 24 for an operator and a control panel with manual controls (not shown).

Still referring to FIG. 1, tunnel 12 is provided in the following manner. Trailer 22 is positioned relatively close to the the starting point of the tunnel and an entry opening is manually provided for containing a curved launching tube 26, as shown. The thrust conduit 16 is initially wound around a reel 28 which forms part of overall reel assembly 18. The forwardmost end of the thrust conduit is connected to the back end of boring device 14 and the latter is manually positioned within the entry of launch tube 26. Thereafter, a boring arrangement forming part of device 14 is activated, while at the same time, thrust assembly 20 acts on conduit 16 for thrusting the conduit forward along its axis in the direction of the boring device. Thus, as the device 14 bores through the soil it is literally pushed forward by the thrust conduit until the boring device reaches its destination.

Turning to FIG. 2, the boring device 14 is shown in more detail. As seen there, this device includes an elongated main body 30 and a separate boring head 32 mounted to the body for rotation about the axis of the latter, as will be described in more detail hereinafter. A motor which will also be described in more detail hereinafter is contained within body 30 for rotating the boring head and the latter is provided with a plurality of nozzles 34 which face forward but which are positioned off-center with respect to the axis of the boring device, again as will be described in more detail hereinafter. A source of pressurized cutting fluid comprising, for example water and clay particles, is directed to nozzles 34 through a cooperating high pressure fluid line in order to produce off center cutting jets 36. A source of cutting fluid is generally indicated at 38 (see FIG. 1) and the pressure line between the source and nozzles is diagrammatically illustrated at 40. As described in the copending system application, this high pressure line extends from source 38 to boring head 32 through thrust conduit 16.

In order for device 14 to bore through the soil and provide tunnel 12 of uniform diameter along a straight path, cutting jets 36 are activated while boring head 32 is rotated about the axis of the boring device at a sufficiently high speed to bore out an opening slightly larger than the diameter of the boring device as the latter is urged forward by thrust conduit 16. This presupposes (1) that the pressure of each jet is constant, (2) that the boring head is rotated at a constant speed, (3) that the boring device is urged forward at a constant velocity, and (4) that the soil is of uniform compactness. Under these conditions, boring device 14 will produce a straight tunnel 12 of uniform diameter. The actual diametric size of tunnel 12 depends upon a number of factors including how strong the jets are and their angles of offset, how fast or slot the boring deivce is moved through the soil, how fast the boring head is rotated and the characteristics of the soil or sediment. The tunnel is preferably only sufficiently larger than the boring device to allow the spoils to be forced back behind it and out of the tunnel through the tunnels entry end. In this regard, a supply of air under pressure which is generally indicated at 42 in FIG. 1 may be connected to one or more air nozzles 48 on boring head 32 (see FIG. 2) by means of a cooperating air pressure line 46 to produce one or more air jets 48 at the front and/or rear end of the boring device. These air jets when utilized aid in forcing the spoils back out of tunnel 12. Air line 46 and a power line 50 for bringing power to the motor in boring device 14 for rotating boring head 32 and also for bringing power to certain control mechanisms within the boring head to be described hereinafter may be contained within thrust conduit 16 along with cutting fluid line 40.

The discussion provided immediately above assumed among other things that boring device 14 is caused to move through the soil along a straight line path. So long as that is the case, it is merely necessary to rotate this boring head 32 at a constant speed in order to maintain its straight line movement assuming jet line pressure is maintained constant and that the soil extending entirely around the bore head is of uniform compactness. This is best exemplified in FIG. 3*a* which diagrammatically illustrates the boring device 14 as it provides a straight tunnel 52. This is accomplished because the cutting jets 36 cut away the soil in front of the device uniformly around its boring head. As it does so, the boring device is continuously urged forward into the cut away in front of it, which cut away is generally indicated at 54*a*.

In accordance with one aspect of the present invention, it is desirable to be able to cause the boring device 14 to follow a non-linear path. One way that this has been accomplished in the past has been to physically turn the boring head of the device off axis with respect to its main body. This has been found to be difficult to do and not always reliable, particularly in relatively compact soil. Steering is accomplished in accordance with the present invention without turning the head off axis at all. Rather, as will be described immediately below, the axial rotation of boring head 32 is modulated in a controlled way so that the cutting jets spend more time along a particular segment of their rotating paths than on the rest of their paths of movement, depending upon the particular path to be taken by the overall device. This is exemplified in FIGS. 3*b* and 3*c*. As seen there, rotation of boring head 32 is modulated in a way which causes the cutting jets to spend more time along a vertically downward segment of their rotational paths. This causes more of the soil in that direction to be cut away than along the rest of the circumference around the boring head. Thus, the cut away at the head of tunnel 52 in FIGS. 3*b* and 3*c* take on the downward orientation, first gradually as illustrated at 54*b* in FIG. 3*b* and then more acutely as shown at 54*c* in FIG. 3*c*. At the same time, the overall boring device is being urged forward by means of conduit 16. As a result, the boring device is turned downward into the cut away and eventually turns with it. Assuming it is desirable merely to make a downward, 90° turn, once cut away 54*c* is formed, uniform rotation of the boring head would be resumed in order to form a downwardly extending, straight tunnel section.

Turning now to FIGS. 4 and 5*a–c*, attention is directed to the way in which boring head 32 is modulated rotationally in order to turn the overall device. To this end, only certain components of boring device 14 are illustrated in FIG. 4, they include its main body 30, its boring head 34 and cutting jet nozzles 34, a variable speed, reversible DC motor 56 and a planetary gear box 58 which couples motor 56 to boring head 32 for driving the latter. The motor is powered and controlled by an external source, as previously indicated, and by suitable control means which may be located in overall process control panel 60 illustrated in FIG. 1 through power line 50. As shown in FIG. 4, boring head 32 includes a rearwardly extending stem 62 which defines its axis of rotation coaxial with the elongation axis of the boring device and which is rotatably connected to the output shaft of motor 56 through planetary gear box 58. In this way, a variable speed, reversible motor is able to rotate boring head 32, either clockwise or counterclockwise, about the axis of stem 62 and therefore about the elongation axis 63 of the boring device at varying speeds. As a result, the nozzles 34 and their associates cutting jets 36 which are located off axis with respect to elongation axis 63 may be rotated clockwise or counterclockwise about elongation axis 63 at varying speeds. This is best illustrated in FIGS. 5*a*, 5*b* and 5*c* where one of the cutting jets 34 and its associated path of movement are illustrated diagrammatically by means of a number of arrows. FIG. 5*a* diagrammatically illustrates a path of movement of the cutting jet when the boring head is rotated in the same direction, for example counterclockwise, at a constant speed. Under these circumstances, the boring device will follow a straight line path. In FIG. 5*b*, the cutting jet is shown spending more time along a right hand segment of its path in order to cause the boring device to turn to the right. FIG. 5*c* diagrammatically illustrates the cutting jet spending more time along an upper segment of its path so as to cause the device to turn upward. There are different ways to modulate boring head 32 in order to cause the boring device to make a turn. It can be rotated at a constant speed but reciprocated back and forth through the preferred segment, as illustrated by the plurality of adjacent arrows in FIG. 5*b*; it can be moved in the same direction but slower through the preferred segment as illustrated diagrammatically by the enlarged arrow in FIG. 5*c*; or a combination of both of these latter approaches can be used. In any of these cases, it is only necessary to control motor 56 through, for example, controls at panel 60 to accomplish the desired end.

Obviously, one primary reason to steer boring device 14 in a controlled manner is to cause it to follow a particular, predetermined path of movement through the ground. In order to do this, it is critical to monitor the position and orientation of the boring device generally and the position of the cutting jets in particular relative to the fixed reference, for example the ground plane. This includes the pitch angle of the boring device independent of its roll angle, its roll angle relative to a given reference and the positions of its cutting jets with respect to its roll angle. All of these orientation aspects of the boring device are monitored in accordance with the present invention, as will be described in detail hereinafter. In addition, the depth of the boring device can be monitored by suitable known means and its position along its path of movement is the subject of copending patent applications Ser. No. 866,242 filed on May 22, 1987 and entitled ARRANGEMENT FOR AND METHOD OF LOCATING A DISCRETE IN-GROUND BORING DEVICE.

Turning now to FIG. 6, attention is directed to an arrangement 64 which is designed to monitor the roll angle of the boring device, that is, its angular position with respect to elongation axis 63, relative to a reference roll position. As illustrated in FIG. 6, arrangement 64 includes a cylindrical support housing 66 and an electrical resistor element 68 mounted concentrically about an inner surface of the housing, as shown. This resistor element forms part of an overall potentiometer which also includes a brush or contact member 70 extending radially from and mounted to a support arm 72. The support arm extends coaxially through housing 66 and the latter is supported for 360° rotation, both clockwise and counterclockwise, about the support arm by suitable end bearings 74. The support arm is biased vertically downward in the gravitational direction by means of a weight 76 connected to the support arm by a rigid rod 78 and connector 80 so as to hang freely, as shown. In that way, brush 70 is biased in the vertically downward direction shown and the support arm will not rotate about its own axis.

FIG. 7 schematically illustrates the electrical equivalent of resistor element 68 and brush 70 along with a power supply 82 and either a current meter 84 (FIG. 7A) or a volt meter 86 (FIG. 7B). Note that the free ends of the resistor 68 are connected through cooperating terminals 87 to opposite sides of the power supply which is externally located, for example at control panel 60. Electrical leads between these terminals and the power supply can be contained within thrust conduit 16.

Having described arrangement 64 both structurally and electrically, attention is now directed to the way in which it functions to monitor the roll position of boring device 14. At the outset, it should be noted that arrangement 64 is mounted in the boring device's main body 30 such that support arm 72 is parallel with and preferably coaxial with elongation axis 63 of the device such that as the boring device rolls about its elongation axis support housing 66 rotates with it. With this in mind, it will first be assumed that FIG. 6 illustrates arrangement 64 with the boring device in its reference roll position. Under these circumstances, brush 70 contacts resistor element 68 at a point centrally between terminals 86. This, in turn, results in a particular reference current or voltage which may be calibrated at control panel 60 to indicate the reference position. As the boring device moves in one direction about its elongation axis, for example clockwise, support housing 66 rolls with it causing resistor element 68 to rotate clockwise relative to brush 70, thereby increasing or decreasing the amount of resistance in the circuit of FIG. 7. When the boring device rolls in the opposite direction the opposite occurs. In otherwords, the resistance in the circuit of FIG. 7 increases and decreases with the roll angle of the boring device relative to its reference position. As illustrated in FIG. 6, there is one point when brush 70 looses complete contact with the resistor element, specifically between the terminals 86 and therefore at that point an open circuit occurs between the terminals and the current goes to zero. In the particular embodiment illustrated in FIG. 6, this represents approximately a 180° roll angle with respect to the reference position.

The reason that it is important to be able to monitor the roll angle of boring device 14 relative to a given reference position is so that the cutting jets 36 can be monitored relative to the reference position. FIG. 8 illustrates an arrangement 90 for accomplishing this. Arrangement 90 includes Hall effect sensors 92 which are supported concentrically around an end section 94 of boring head stem 62 by suitable means not shown in FIG. 8. These eight Hall effect sensors define 16 sensing positions a,b, c, and so on. A magnet 96 is fixedly mounted on stem section 94 so as to rotate with the latter as the boring head is rotated about the elongation axis 63 of the boring device in the manner described previously. As seen in FIG. 8, magnet 96 is positioned in alignment with one of the nozzles 34, for example nozzle 34*a*. At the same time, the magnet is positioned in sufficiently close proximity to the Hall effect sensors and the latter form part of a readily providable circuit which detects the exact position of magnet 96 with respect to the various Hall effect sensing points a, b and so on by producing corresponding discrete signals. This latter circuitry may be provided on board the boring device, that is, within its main body 30 and powered by an external source through thrust conduit 16 or it may be located, for example, at panel 60.

Having described arrangement 90, attention is now directed to the way in which it functions to continuously monitor the position of the cutting jets relative to a reference position. To this end, let it be assumed that the roll position of the boring device is initially in its reference position illustrated in FIG. 6 and that boring head 32 is in the position illustrated in FIG. 8. Under these circumstances, previously described arrangement 64 would indicated that main body 30 is in its reference position and this would, in turn, determine the various positions of Hall effect sensors 92. At the same time, arrangement 90 would indicate the position of cutting jet nozzle 34*a* with respect to the Hall effect sensors by the position of magnet 96 and therefore this information can be combined by readily providable circuitry to monitor the position of nozzle 34*a* with respect to the roll angle reference position. As a result, even if the boring device's main body rolls and causes the Hall sensors to roll with it, the cutting jet nozzle 34*a* can always be located relative to the initial reference roll position and therefore the positions of all the cutting jets can be accurately monitored. This, in turn, allows the cutting jets to be accurately modulated to steer the boring device.

Turning now to FIG. 9, attention is directed to an arrangement 100 designed in accordance with the present invention for monitoring the pitch angle of boring device 14, independent of its roll angle. This arrangement will first be described electrically, as follows. An AC reference source 102, externally located with respect to boring head 14, is connected to the opposite inputs of a differential amplifier 103 through a voltage divider consisting of variable resistors 104 and 106, and fixed resistors 400 and 401. The output of differential amplifier 103 is fed to processing circuitry 107 which is connected at its output to a suitable indicating or recording device 108.

The amount of resistance in each of the resistors 104 and 106 depends directly upon the pitch angle of boring device 14, independent of its roll angle. When the boring device is perfectly horizontal so as to display a pitch angle of zero, the two resistors are equal and balanced. Thus, the voltage across the two from power supply 102 is divided equally and the output from differential amplifier 103 is zero. As a result, the processing circuitry 107 responds to this output to cause device 108 to indicate a pitch angle of zero. If the pitch angle goes positive, that is, if the head of the boring device moves upward relative to its back end, one of the resistors increases in resistance relative to the other. This results in an imbalance across the inputs to the differential amplifier which, in turn, is reflected at its output. Processing circuitry 107 responds to this output signal to drive device 108 so that the latter indicates the precise pitch angle of the boring device. As will be seen directly below, arrangement 100 functions in this manner independent of the roll position of the boring device. In other words, if the boring device is in its reference roll position or another roll position, arrangement 100 will accurately sense its pitch angle.

Turning to FIGS. 10 and 11 attention is directed to an assembly 110 which provides adjustable resistors 104 and 106 forming part of arrangement 100. Assembly 110 is comprised of an open ended dielectric cylindrical tube 112 which is comprised of two separate sections and which is closed at its opposite ends by electrically conductive end caps 114 and 116. These end caps have internal surfaces 114*a* and 116*a*, respectively, in direct communication with the interior of tube 112. A third electrically conductive, annular member is disposed around tube 112 and separates the latter into its two sections which are indicated at 120 and 122. These sections and member 118 cooperate with one another so that the annular segment 118*a* of member 118 is in direct communication with the interior of the tube, as illustrated in FIG. 10.

Still referring to FIG. 10 in conjunction with FIG. 9, it should be noted first that reference source 102 is connected to the variable resistors 104 and 106 through a terminal T1 and the inputs of differential amplifier 104 are connected to opposite ends of the resistors through terminals T2 and T3. Resistors 400 and 401 as shown FIG. 9 are of equal value, their nominal value is 10,000 ohm, roughly equal to 104 and 106. Electrically conductive member 118 functions as the terminal T1 while electrically conductive end caps 114 and 116 serve as terminals T2 and T3. The tube 112 is partially filled with electrolytic solution 124, for example sodium chloride. As illustrated in FIG. 10, the electrolytic solution is always in contact with member 118, that is, terminal T1. At the same time, the solution covers a certain surface area of each of the surfaces 114*a* and 116*a*, that is, the surfaces forming part of terminals T2 and T3. The assembly 110 is fixedly positioned within the main body 30 of boring device 14 such that the axis of tube 112 is parallel with the boring devices' elongation axis 63. The remaining components making up arrangement 100, except for the power supply and indicator 108, are preferably positioned on board the boring device. The power supply and indicator may be located in control panel 60 and connected with the rest of the circuitry through thrust cable 16.

Having described arrangement 100 and its assembly 110 electrically and structurally, attention is now directed to the way in which assembly 110 functions as variable resistors 104 and 106 to monitor the pitch angle of the boring device independent of its roll angle. Assuming first that the boring device is perfectly horizontal and thus defines a pitch angle of zero, it should be noted that the electrolytic solution 124 is level across the entire tube 112. As a result, it engages equal surface areas along surfaces 114*a* and 116*a*. As a result, the solution defines paths of equal conductivity (and resistivity) between these surfaces and member 118. This corresponds electrically to the situation where resistors 104 and 106 are of equal resistance. Note that this is true regardless of the roll position of the boring device, that is, electrolytic solution 124 will remain level regardless of the boring device's roll angle and therefore will provide equal resistance between the end caps 114 116 and member 118. If the pitch angle changes, the tube 120 will change with it causing more of the electrolytic solution to cover one of the surfaces 114*a*, or 116*a* than the other. As a result, the path of conductivity between the surface covered by more of the solution and member 118 will be greater than the conductivity between the surface covered by less of the solution and member 118. This corresponds to a greater amount of resistance between these latter members than the former ones. Again, it should be clear that this is independent of the boring devices roll position.

Turning now to FIG. 12, an actual working embodiment of boring device 14 is shown including a number of features which are not pertinent to the various aspects of the present invention including, for example, the way in which cutting fluid reaches nozzles 34 and the way in which the boring head 32 sits within main body 30. This figure also illustrates motor 56 and planetary gear box 58 within main body 30 and a coupling member 94' which serves to disengagably couple stem 62 to the planetary gear box and which also functions as the previously described stem section 94. Located behind the DC motor is a box 130 which is designed to contain arrangement 64 and assembly 110 as well as their associated on-board circuitry described above. The array of Hall effect sensors 92 are shown mounted to and in front of gear box 58. In an actual working embodiment of the boring head 32 including its stem 64 is illustrated by itself in FIG. 13.

It is to be understood that the various aspects of the present invention, as described above and as illustrated even in FIGS. 12 and 13 are not intended to limit the present invention. For example, the circuitry associated with arrangements 64, 90 and 100 may vary from the exemplary circuitry illustrated and, in any event, could be readily provided with ordinary skill in the art in view of the present teachings.

What is claimed is:

1. An apparatus for providing a continuous underground tunnel, comprising:

(a) an elongated boring device having a central elongation axis and an axially extending main body, a forward boring head coaxially positioned with and rotatably mounted to said main body, and a nozzle on said boring head in a forward facing position off axis with respect to said device;

(b) means for supplying fluid under pressure to said nozzle whereby to produce a pressurized fluid jet at the output of said nozzle in a direction forward of and off axis with respect to said device, said jet being sufficiently strong to bore through soil;

(c) means for urging the boring device forward as said jet is being produced whereby to cause the device to move forward into the area being bored out by said jet; and (d) means for moving said boring head and nozzle about the axis of the device in a first way for causing the device to move forward along a straight path and in a second way for causing the device to move forward along a particular curved path that depends upon the way in which the boring head is rotated, said means for moving said boring head including means for rotating said boring head in said one way at a constant speed around the axis of said boring device so as to cause the boring device to move along a straight path and means for moving said boring head in said second way about the axis of said boring device such that said fluid jet spends more time along a particular segment of its path about said axis than on the rest of its path of movement so that the particular segment of said path determines the particular curved path taken by the boring device.

2. An apparatus according to claim 1 wherein said means for moving said boring head includes a motor connected with said boring head and means for modulating the speed of said motor and therefore the speed of said boring head depending upon the path to be taken by said boring device.

3. An apparatus according to claim 2 wherein said motor is a reversible motor and wherein said means for modulating the speed of said motor and boring head includes means for modulating the direction of rotation of said motor and boring head depending upon the path to be taken by said boring device.

4. An apparatus according to claim 3 wherein said motor is located within said main body of said boring device.

5. An apparatus according to claim 1 including means for monitoring the pitch angle defined by the central axis of said boring devcie relative to a horizontal ground plane when the device is in the ground, independent of the roll position of the device.

6. An apparatus according to claim 1 including means for monitoring the roll angle of said boring device relative to a reference roll position and means for monitoring the rotational position of said fluid jet relative to a given reference whereby to be able to determine the rotational position of said jet relative to said reference roll position.

7. An apparatus according to claim 1 including means for monitoring the pitch angle defined by the central axis of said boring device relative to a horizontal ground plane when the device is in the ground, independent of the roll position of the device, and further including means for monitoring the roll angle of said boring device relative to a reference roll position and means for monitoring the rotational position of said fluid jet relative to a given reference whereby to be able to determine the rotational position of said jet relative to said reference roll position.

8. In an apparatus for providing a continuous underground tunnel by means of an elongated boring device including a forward facing off-axis high pressure fluid jet which is rotated at a constant rate about the elongation axis of the device while the latter is urged forward through the soil whereby to cause the device to move forward along a straight line path while boring a tunnel in the soil as it does so, the improvement comprising means for varying the speed and/or the direction of rotation of said fluid jet in a controlled way depending upon the desired direction to be taken by the boring device as it moves forward through the soil, whereby to cause the boring device to move along a curved path of movement in a controlled way, said controlled way of varying the speed and/or direction of rotation of said boring device being such that said fluid jet spends more time along a particular segment of its rotating path than on the rest of its path of movement so that the particular segment of said rotating path determines the particular curved path taken by the boring device.

9. The improvement according to claim 8 including means for monitoring the pitch angle defined by the elongation axis of the boring device relative to a horizontal ground plane when the device is in the ground, independent of the roll position of the device.

10. The improvement according to claim 9 including means for monitoring the roll angle of said boring device relative to a reference roll position and means for monitoring the rotational position of said fluid jet relative to a given reference whereby to be able to determine the rotational position of said jet relative to said reference roll position.

11. In an apparatus for providing an underground tunnel by means of an elongated boring device which is caused to move through the soil underground, the improvement comprising means for monitoring the pitch angle defined by the elongation axis of said boring device relative to a horizontal ground plane, independent of the roll position of the device, said monitoring means including a sensor carried by said device for producing signals corresponding to the pitch of the device independent of its roll position and means for detecting and processing said signals, said sensor including (a) a closed, hollow tubular container having its axis positioned parallel with the elongation axis of said boring device and defining a co-axially extending internal chamber having opposite ends, (b) electrical circuit means including first and second contact means located within and at the opposite ends of said chamber and a third contact means located within and extending around said chamber at a point intermediate its opposite ends, (c) an electrolytic solution partially filling said chamber so as to make contact with all three of said contact means, the extent of contact being made by the solution with said first and second contact means depending on the pitch angle of said boring device but independent of its roll position and said signals depending upon the extent of contact being made by the solution with said first and second contact means.

12. The improvement according to claim 11 wherein said first and second contact means include electrically conductive first and second face plates facing one another on each end of said chamber and said third contact means includes a ring shaped contact such that said first and third contact means and the electrolytic solution therebetween produces a first signal and the second and third contact means and the electrolytic solution therebetween produces a second signal, the strength of each of said first and second signal being proportionate to the surface area of each of said first and third face plates, respectively, covered by said electrolytic solution.

13. The improvement according to claim 12 wherein said signal detecting and processing means includes circuit means for determining the difference in strength between said first and second signals.

14. The improvement according to claim 11 including means for monitoring the roll angle of said boring device relative to a reference roll position.

15. The improvement according to claim 14 wherein said roll angle monitoring means includes a potentiometer having an annular resistance element mounted on said boring device in coaxial relationship with its elongation axis, a wiper arm connected with said resistance element such that the latter is rotatable about its own axis relative to the wiper arm, and means for gravitationally biasing the wiper arm vertically downward.

16. An arrangement for monitoring the pitch angle defined by the elongation boring axis of an elongated device relative to a horizontal ground plane, indepenent of the roll position of the device, said arrangement comprising a sensor carried by said device for producing signals corresponding to the pitch of the device independent of its roll position and means for detecting and processing said signals, said sensor including (a) a closed, hollow tubular container having its axis positioned parallel with the elongation axis of said boring device and defining a co-axially extending internal chamber having opposite ends, (b) electrical circuit means including first and second contact means located within and at the opposite ends of said chamber and a third contact means located within and extending around said chamber at a point intermediate its opposite ends, and (c) an electrolytic solution partially filling said chamber so as to make contact with all three of said contact means, the extent of contact being made by the solution with said first and second contact means depending on the pitch angle of said boring device but independent of its roll position and said signals depending upon the extent of contact being made by the solution with said first and second contact means.

17. An arrangement according to claim 16 wherein said first and second contact means include electrically conductive first and second face plates facing one another on each end of said chamber and said third contact means includes a ring shaped contact such that said first and third contact means and the electrolytic solution therebetween produces a first signal and the second and third contacts means and the electrolytic solution therebetween produces a second signal, the strength of each of said first and second signal being proportionate to the surface area of each of said first and third face plates, respectively, covered by said electrolytic solution.

18. An arrangement according to claim 17 wherein said signal detecting and processing means includes circuit means for determining the difference in strength between said first and second signals

19. An arrangement according to claim 18 including means for monitoring the roll angle of said boring device relative to a reference roll position.

20. An arrangement according to claim 19 wherein said roll angle monitoring means includes a potentiometer having an annular resistance element mounted on said boring device in coaxial relationship with its elongation axis, a wiper arm connected with said resistance element such that the latter is rotatable about its own axis relative to the wiper arm, and means for gravitationally biasing the wiper arm.

21. In an apparatus for providing an underground tunnel by means of an elongated boring device which is caused to move through the soil underground, said boring device having a central elongation axis and including an axially extending main body, a forward boring head coaxially positioned with and rotatably mounted to said main body, and a nozzle on said boring head for providing a fluid jet in a forward facing position off-axis with respect to said device, the improvement comprising means for monitoring the roll angle of said boring device relative to a reference roll position and means for monitoring the rotational position of said fluid jet relative to a given reference whereby to be able to determine the rotational position of said jet relative to said reference roll position, said roll angle monitoring means including a potentiometer having an annular resistance element mounted on said boring device in coaxial relationship with its elongation axis, a wiper arm connected with said resistance element such that the latter is rotatable about is own axis relative to the wiper arm, and means for gravitationally biasing the wiper arm.

22. An apparatus according to claim 21 including means for monitoring the pitch angle defined by the central axis of said boring device relative to a horizontal ground plane when the device is in the ground, independent of the roll position of the device.

23. A method for providing a continuous underground tunnel, comprising the steps of:

(a) providing an elongated boring device having a central elongation axis and including an axially extending main body, a forward boring head coaxially positioned with and rotatably mounted to said main body, and a nozzle on said boring head in a forward facing position off axis with respect to said device;

(b) supplying fluid under pressure to said nozzle whereby to produce a pressurized fluid jet at the output of said nozzle in a direction forward of and off axis with respect to said device, said jet being sufficiently strong to bore through soil;

(c) urging the boring device forward as said jet is being produced whereby to cause the device to move forward into the area being bored out by said jet; and (d) moving said boring head and nozzle about the axis of the device in a first way for causing the device to move forward along a straight path and in a second way for causing the device to move forward along a particular curved path that depends upon the way in which the boring head is rotated, said boring head being moved in said one way so as to rotate at a constant speed around the axis of said boring device whereby to move forward along a straight path and being moved in said second way so as to rotate about the axis of said boring device such that said fluid jet spends more time along a particular segment of its rotating path than on the rest of its path of movement so that the particular segment of said rotating path determines the particular curved path taken by the boring device.

24. A method according to claim 23 including the step of monitoring the pitch angle defined by the central axis of said boring device relative to a horizontal ground plane when the device is in the ground, independent of the roll position of the device.

25. A method according to claim 23 including the steps of monitoring the roll angle of said boring device relative to a reference roll position and monitoring the rotational position of said fluid jet relative to a given reference whereby to be able to determine the rotational position of said jet relative to said reference roll position.

26. In a method for providing a continuous underground tunnel by means of an elongated boring device including a forward facing off-axis high pressure fluid jet which is rotated at a constant rate about the elongation axis of the device while latter is urged forward through the soil whereby to cause the device to move forward along a straight line path while boring a tunnel in the soil as it does so, the improvement comprising the step of varying the speed and/or the direction of rotation of said fluid jet in a controlled way depending upon a desired curved path to be taken by the boring device as it moves forward through the soil, said controlled way of varying the speed and/or direction of rotation of said boring device being such that said fluid jet spends more time along a particular segment of its rotating path than on the rest of its path of movement so that the particular segment of said rotating path determines the particular curved path taken by the boring device.

27. In an apparatus for providing an underground tunnel by means of an elongated boring device which is caused to move through the soil underground, said boring device having a central elongation axis and including an axially extending main body, a forward boring head coaxially positioned with and rotatably mounted to said main body, and a nozzle on said boring head for providing a fluid jet in a forward facing position off-axis with respect to said device, the improvement comprising means for monitoring the roll angle of said boring device relative to a reference roll position and means for monitoring the rotational position of said fluid jet relative to a given reference whereby to be able to determine the rotational position of said jet relative to said reference roll position, said roll angle monitoring means including a potentiometer having an annular resistance element mounted on said boring device in coaxial relationship with its elongation axis, a wiper arm connected with said resistance element such that the latter is rotatable about its own axis relative to the wiper arm, and means for gravitationally biasing the wiper arm, said means for monitoring the rotational position of said jet including a magnetic circuit including a first circuit component made up of a series of circumferentially spaced-apart Hall effect sensors defining a circle and fixedly mounted to and coaxially with said main body and a second circuit component including a single magnet mounted to said boring head.

* * * * *